US006754922B2

(12) United States Patent
Dewert

(10) Patent No.: US 6,754,922 B2
(45) Date of Patent: Jun. 29, 2004

(54) MOTOR-DRIVEN, ADJUSTABLE SUPPORTING DEVICE FOR THE UPHOLSTERY OF SEATING AND/OR RECLINING FURNITURE, FOR EXAMPLE OF A MATTRESS OR A BED

(75) Inventor: Eckhart Dewert, Zürich (CH)

(73) Assignee: Cimosys AG, Goldingen (CH)

( * ) Notice: Subject to any disclaimer, the term of this patent is extended or adjusted under 35 U.S.C. 154(b) by 0 days.

(21) Appl. No.: 10/176,615

(22) Filed: Jun. 24, 2002

(65) Prior Publication Data

US 2002/0162170 A1 Nov. 7, 2002

Related U.S. Application Data

(63) Continuation of application No. PCT/EP00/13084, filed on Dec. 21, 2000.

(30) Foreign Application Priority Data

Dec. 23, 1999 (DE) ..... 199 62 541

(51) Int. Cl.[7] ..... A61G 7/06
(52) U.S. Cl. ..... 5/617; 5/616; 5/613
(58) Field of Search ..... 5/613, 616, 617, 5/614

(56) References Cited

U.S. PATENT DOCUMENTS

| | | | | |
|---|---|---|---|---|
| 3,300,794 A | * | 1/1967 | Altorfer | 5/616 |
| 3,868,103 A | * | 2/1975 | Pageot et al. | 5/614 |
| 4,381,571 A | | 5/1983 | Elliott | |
| 4,463,463 A | * | 8/1984 | Kaneko | 5/616 |
| 4,800,599 A | | 1/1989 | Korchinski et al. | |
| 5,063,623 A | | 11/1991 | Bathrick et al. | |

(List continued on next page.)

FOREIGN PATENT DOCUMENTS

| | | | |
|---|---|---|---|
| CH | 607 682 | | 10/1978 |
| DE | 31003922 | A1 | 8/1982 |
| DE | 32 182 78 | A1 | 11/1983 |
| DE | 87 11 567 | U1 | 3/1988 |
| DE | 88 00 360 | U1 | 7/1988 |
| DE | 88 06 094 | U1 | 8/1988 |
| DE | 3842078 | A1 * | 7/1989 |

(List continued on next page.)

OTHER PUBLICATIONS

Catalogue of the German firm Dewert Antreibs–und Systemtechnik "Gesamtprogramm 1995/96" pp. 12 & 13.
Catalogue of the German firm Dewert Antreibs–und Systemtechnik "Antriebe, Handschalter, Steuerungen, Beschläge", No. 05/97 (excerpt 6 pages).
International Preliminary Examination Report (PCT) Article 36 & Rule (70), dated Apr. 30, 2002 for International Application No. PCT/EP00/13804 (4 pgs).
International Search report for International Application No. PCT/EP00/13084 dated Jun. 15, 2001 (4 pgs).
PCT Schriftlicher Bescheid (Regel 66 PCT) dated Nov. 14, 2001 (6 pgs).

*Primary Examiner*—Michael F. Trettel
(74) *Attorney, Agent, or Firm*—Shlesinger Arkwright & Garvey LLP

(57) ABSTRACT

Motor-driven, adjustable supporting device for the upholstery of seating and/or reclining furniture, e.g. a mattress or a bed, has a first supporting part and at least a second supporting part for the support of a mattress over its surface. The first supporting part and the second supporting part are jointedly connected to one another and are pivotable relative to one another by a drive. The drive may have at least one electromotive drive which is disposed on the first supporting part in such a way that an output element of the drive is disposed between an upper limiting plane and a lower limiting plane of the first supporting part.

24 Claims, 5 Drawing Sheets

U.S. PATENT DOCUMENTS

| | | | | | |
|---|---|---|---|---|---|
| 5,490,298 | A | | 2/1996 | Goldsmith et al. | |
| 5,491,854 | A | | 2/1996 | Music | |
| 5,542,744 | A | | 8/1996 | Bathrick | |
| 5,675,849 | A | * | 10/1997 | Koch | 5/616 |
| 5,687,437 | A | | 11/1997 | Goldsmith | |
| 5,740,568 | A | | 4/1998 | Elliott | |
| 5,926,877 | A | * | 7/1999 | Lin | 5/618 |
| 6,088,853 | A | * | 7/2000 | Jansen | 5/618 |
| 6,105,187 | A | * | 8/2000 | Gnjatovic | 5/618 |
| 6,209,157 | B1 | | 4/2001 | Hensley | |
| 6,269,707 | B1 | * | 8/2001 | Koch | 74/89.23 |
| 6,311,348 | B1 | * | 11/2001 | Luff et al. | 5/618 |
| 6,393,641 | B1 | | 5/2002 | Hensley | |
| 2002/0152552 | A1 | | 10/2002 | Dewert | |
| 2003/0052238 | A1 | | 3/2003 | Schneider | |
| 2003/0079290 | A1 | | 5/2003 | Dewert | |

FOREIGN PATENT DOCUMENTS

| | | | |
|---|---|---|---|
| DE | 38 42 078 | C2 | 7/1992 |
| DE | 93 11 520 | U1 | 6/1994 |
| DE | 195 00 185 | A1 | 7/1996 |
| DE | 195 03 650 | A1 | 8/1996 |
| DE | 195 42 321 | A1 | 5/1997 |
| DE | 297 01 084 | U1 | 7/1997 |
| DE | 197 39 453 | A1 | 3/1999 |
| DE | 695 07 158 | T2 | 9/1999 |
| DE | 299 07 850 | U1 | 10/1999 |
| DE | 200 00 700 | U1 | 5/2000 |
| EP | 0 373 912 | | 6/1990 |
| EP | 0 372 032 | B1 | 5/1992 |
| EP | 0 568 957 | A1 | 11/1993 |
| EP | 0 583 660 | A1 | 2/1994 |
| EP | 0 721 754 | A1 | 7/1996 |
| EP | 0 873 709 | A1 | 10/1998 |
| EP | 0 884 011 | A1 | 12/1998 |
| EP | 0 935 937 | A1 | 8/1999 |
| WO | 91/01099 | | 2/1991 |
| WO | 92/09520 | | 6/1992 |
| WO | 96/29970 | | 10/1996 |
| WO | 99/42021 | | 8/1999 |

* cited by examiner

MOTOR-DRIVEN, ADJUSTABLE SUPPORTING DEVICE FOR THE UPHOLSTERY OF SEATING AND/OR RECLINING FURNITURE, FOR EXAMPLE OF A MATTRESS OR A BED

CROSS REFERENCE TO RELATED APPLICATIONS

This application is a continuation of Application No. PCT/EP00/13084, filed Dec. 21, 2000, which claims priority of German Application No. 199 62 541.7, filed Dec. 23, 1999, and each of which is incorporated herein by reference.

This application relates to assignee's concurrently filed application entitled "ADJUSTMENT PADDING DEVICE FOR A PIECE OF FURNITURE USED FOR SITTING AND/OR LYING UPON" (Ref. No. 7219) and assignee's concurrently filed application entitled "MOTOR ADJUSTABLE SUPPORT DEVICE FOR THE UPHOLSTERY OF A SEAT AND/OR RECLINING FURNITURE" (Ref. No. 7220).

FIELD OF THE INVENTION

The invention relates to a motor-driven, adjustable supporting device for the upholstery of seating and/or reclining furniture, e.g. of a mattress or of a bed, of the type having jointedly connected parts and a drive for moving the parts relative to each other.

BACKGROUND OF THE INVENTION

Supporting devices of this type are generally known in the form of lath grids. Thus a lath grid is known, by way of example, through DE 195 42 321 A1, said lath grid having several supporting parts jointedly connected to one another for the support of a mattress over its surface which are pivotable relative to one another by drive means. In the known lath grid the drive means are formed by an adjustment drive whose drive housing is disposed below the actual lath grid.

A disadvantage of this known lath grid consists of the fact that it makes a bulky, and thus visually unattractive, impression due to the disposition of the relatively space-consuming adjustment drive.

A further disadvantage consists of the fact that the lath grid with the adjustment drive has a significant height. This makes the transport and handling of the lath grid more difficult.

From EP 0 884 001 A1 a similar lath grid is known in which the adjustment drive is also disposed below the actual lath grid. The same disadvantages follow as in the lath grid mentioned previously.

From EP 0 935 937 A1 a lath grid of the type in question is known, said lath grid having a first supporting part and a second supporting part for the support of a mattress over its surface wherein the first supporting part and the second supporting part are jointedly connected to one another and are pivotable relative to one another by a drive means. In order to fashion the lath grid visually more advantageously in the case of the lath grid known from this publication, the drive means are formed by direct-drive motors integrated into pivoted shafts, said direct-drive motors being disposed in the framework of the lath grid. In this way the lath grid is fashioned visually advantageously. It is, however, disadvantageous that the direct-drive motors used are time-consuming in construction and thus expensive to manufacture. This applies in particular when high adjustment forces must be applied and the direct-drive motors must be dimensioned accordingly.

An object of the invention is to specify a supporting device of the type having jointedly connected support parts and which is fashioned visually advantageously and which is simply and cost-effectively manufacturable.

This object is realized by the teachings of the invention set forth below.

A basic concept of the teaching according to the invention consists in disposing the drive so that it does not project over the side bars of the first supporting device, or does so only negligibly.

For this, the invention provides that a drive element of the drive is disposed between an upper limiting plane and a lower limiting plane of the first supporting device.

In this way the drive in the case of a supporting device formed as a lath grid is disposed directly below the laths and visually appears in the background so that the lath grid is fashioned in an optically advantageous manner.

Moreover, through the use of a linear-motion drive the construction of the supporting device according to the invention is simplified and thus more cost-effectively structured.

A particular advantage of the teaching according to the invention consists of the fact that through the disposition, according to the invention, of the drive between horizontal limiting planes of the first supporting device, and thus of the base body of the supporting device, the height of the supporting device in comparison to traditional, non-adjustable supporting devices is not increased, or is increased only negligibly. Thus the supporting device according to the invention is also usable in the case of pieces of filigreed furniture without their visual impression being disadvantageously affected.

Due to the small height of the supporting device with the drive, the teaching according to the invention also makes possible for the first time the integration of the lath grid with a mattress to form one unit. Such an integration is not possible in the case of motor-driven, adjustable supporting devices according to the state of the art due to their resulting height.

The supporting device according to the invention is robust in construction, long-lived, and usable in many ways.

In principle the advantages achieved with the teaching according to the invention are substantially retained if the drive projects negligibly over the first supporting device on the side opposite the upholstery. A particularly advantageous extension of the teaching according to the invention provides however that the drive is disposed essentially completely between the upper limiting plane and the lower limiting plane of the first supporting device. In this embodiment the linear-motion drive does not increase the height of the lath grid.

Another particularly advantageous extension of the teaching according to the invention consists of at least one of the side bars being formed as a hollow profile and the drive being accommodated in the hollow profile. In this embodiment the drive is almost completely covered and thus barely visible.

Another embodiment according to the invention provides that the drive is removably connected to the first supporting device, in particular to one of the side bars. This increases the ease of maintenance of the supporting device according to the invention since, by way of example, a defective drive is replaceable in a simple manner.

The drive is expediently disposed between lateral limiting planes of the first supporting device. In this embodiment the drive also does not project laterally over the supporting device and is thus completely accommodated within its limits.

In the embodiments in which the drive is not accommodated in one of the side bars of the first supporting device, the drive can be accommodated in a housing as another embodiment provides. In this way the drive is protected against damage in handling or transport of the supporting device.

The housing can in the case of the aforementioned embodiments be held on a separated holding part connected to the first supporting device. Expediently the housing is however connected to one of the side bars and/or to a cross bar of the first supporting device. This simplifies the fastening of the housing and simplifies construction.

In principle it is sufficient that a single drive is disposed in each housing. According to the particular requirements however, two drives can be disposed in the housing in such a way that a double drive is formed. In such an embodiment, by way of example, one linear-motion drive can serve for pivoting a leg-supporting device and the other for pivoting an upper body-supporting device.

According to another embodiment the supporting part according to the invention has two side bars spaced relative to one another in the transverse direction of the supporting device, where each side bar is assigned to a housing in which at least one drive is accommodated.

Advantageously the output element of the drive is essentially movable in the longitudinal direction of the supporting device. In this way only a simple pivoting mechanism is required for pivoting a supporting part, by way of example a simple pivoting lever.

An extraordinarily advantageous extension of the teaching according to the invention provides that the drive is a linear-motion drive. Linear-motion drives are available as simple and cost-effective standard components. Moreover, high forces can be applied with linear-motion drives so that an adjustment of the supporting device is also possible under high load without additional efforts.

Expediently in the case of the aforementioned embodiments the output element of the linear-motion drive is a spindle nut which is held, secure against rotation and movable in the screw direction, on a threaded spindle rotatably drivable by the electric motor, where the spindle nut stands in functional connection to a lever mechanism for pivoting at least one of the supporting parts relative to the first supporting part. An arrangement of this type is simple and robust in construction.

Another advantageous extension of the teaching according to the invention provides that the threaded spindle is disposed essentially parallel to the drive shaft of the electric motor and stands in driving connection to it via gearing. In this way the space requirement of the linear-motion drive in the direction of the threaded spindle is reduced. By way of example, the drive shaft and the threaded spindle can be disposed over one another or next to one another.

In principle it is sufficient if the supporting device according to the invention consists of two supporting parts adjustable relative to one another. In the case of this embodiment the possibility for adjustment then consists, by way of example, of adjusting the inclination of a bed in the area of the upper body of a person lying on the bed. It is however advantageous if the supporting device has more than two supporting parts. For this, an embodiment provides that the first supporting part is formed by a central supporting part and the second supporting part by an upper body-supporting part and that a leg-supporting part is provided which is connected, jointedly and pivotably about a pivot axis parallel to the pivot axis of the upper body-supporting part, to the central supporting part on its side opposite its upper body-supporting part. In the case of this embodiment not only the inclination of the upper body-supporting part relative to the central supporting part but rather also the inclination of the leg-supporting part relative to the central supporting part is adjustable. In this way the adjustment possibilities are extended so that the adaptation of the supporting device to the seating or reclining position of a person resting on the mattress supported with the supporting device is improved.

An extension of the aforementioned embodiment provides that a head-supporting part is provided which is connected, jointedly and pivotably about a pivot axis essentially parallel to the pivot axis of the upper body-supporting part, to the upper body-supporting part on its side opposite its central supporting part. Thereby an adjustment of the supporting device in the head area is made possible.

Another advantageous extension of the aforementioned embodiment provides that a calf-supporting part is provided which is connected, jointedly and pivotably about a pivot axis essentially parallel to the pivot axis of the leg-supporting part, to the leg-supporting part on its side opposite the central supporting part. In this embodiment an adjustment of the supporting device in the calf area is made possible in addition.

The supporting device can be formed as a lath grid as a further embodiment provides.

Seating or reclining furniture with a supporting device according to the invention is specified further below.

In the following the invention is explained in more detail with the aid of the accompanying drawings in which various embodiments are represented.

Relative terms such as lengthwise, transverse, up, down, left, right are for convenience only and are not intended to be limiting.

BRIEF DESCRIPTION OF THE DRAWINGS

In the figures of the drawings the same or corresponding parts of the structure are provided with the same reference numbers.

DETAILED DESCRIPTION OF THE INVENTION

Figure 1:
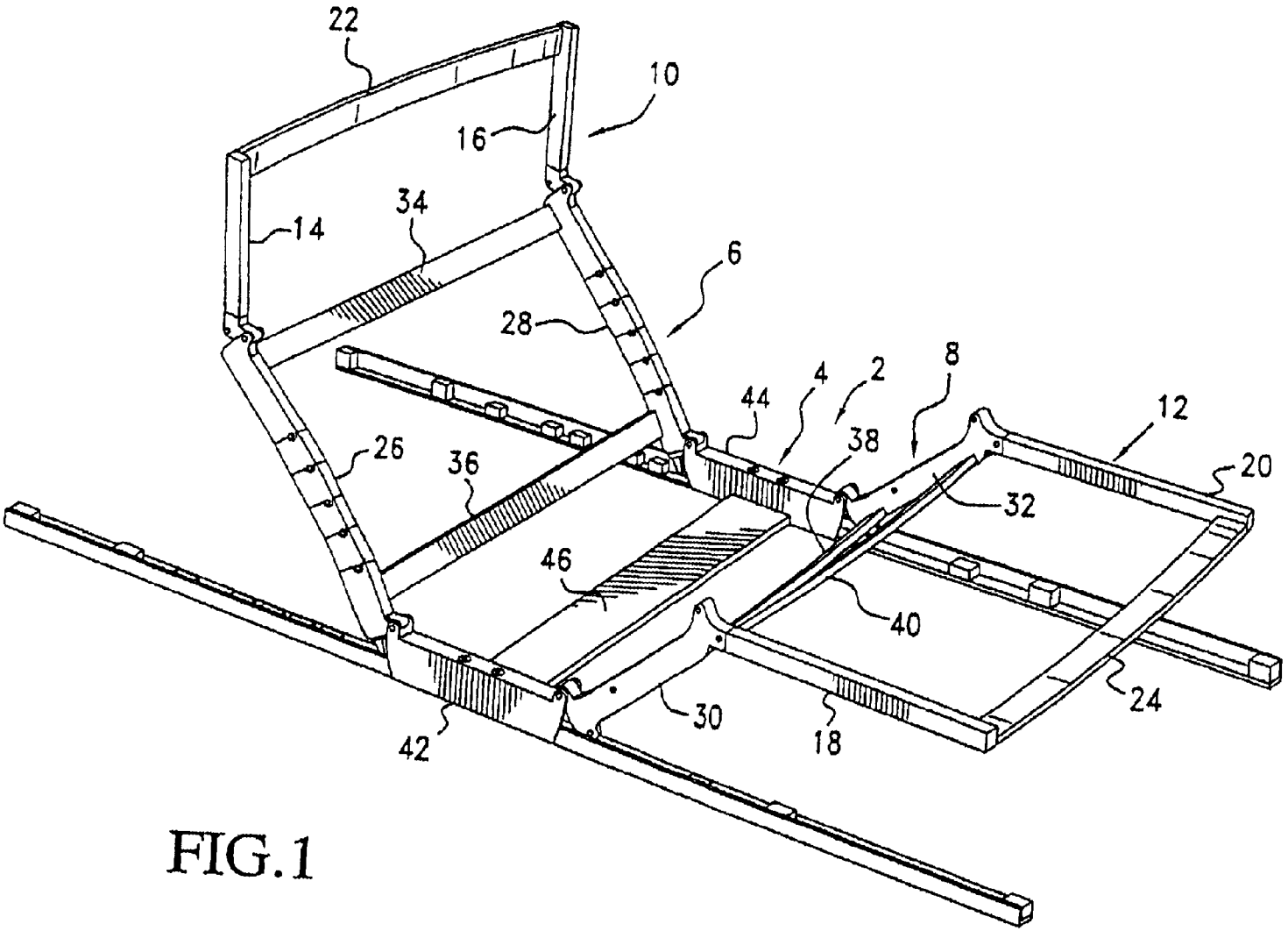
FIG. 1 is a schematic perspective representation of a first embodiment of a supporting device in the form of a lath grid according to the invention wherein the laths of the lath grid are not represented.

In FIG. 1 a lath or slat grid 2 is represented which has, tandem in its longitudinal direction, supporting parts 4, 6, 8, 10, 12 to support a mattress, not represented in the drawing, over its surface.

In detail the lath grid 2 has a first supporting part which forms a central supporting part 4 to which on one side an upper body-supporting part 6 is connected jointedly and pivotably about a horizontal pivot axis and on the side opposite the upper body-supporting part 6 a leg-supporting part 8 is connected jointedly and pivotably about a horizontal pivot axis.

To the upper body-supporting part 6 on its side opposite the central supporting part 4 a head-supporting part 10 is connected jointedly and pivotably about a horizontal pivot axis and to the leg-supporting part 8 on its side opposite the central supporting part 4 a calf-supporting part 12 is connected jointedly and pivotably about a horizontal pivot axis.

The head-supporting part 10 and the calf-supporting part 12 each have side bars 14 and 16 or 18 and 20 which are each connected to one another via a cross bar 22 or 24.

The upper body-supporting part 6 and the leg-supporting part 8 each have side bars 26 and 28 or 30 and 32 which are each connected to one another via a cross bar 34 and 36 or 38 and 40.

The central supporting part 4 has side bars 42 and 44 which are connected to one another via a cross bar 46. The side bars 42 and 44 of the central supporting part 4 are connected to an understructure of the lath grid 2 which if formed by two rails 45 and 47 spaced laterally relative to one another.

In the embodiment represented in FIG. 1 the side bars 42 and 44 of the central supporting part 4 are formed as hollow profiles in each of which electromotive linear-motion drives are accommodated which are not visible in FIG. 1 and serve for the adjustment of the upper body-supporting part 6 and the leg-supporting part 8 relative to the central supporting part 4. In this way the linear-motion drives are located between an upper and a lower limiting plane of the first supporting element 4 as well as between its lateral limiting planes so that the linear-motion drives do not project over the first supporting element 4. Lath grid 2 has a resultant short height, which makes possible an integration of the lath grid 2 with a mattress, not represented in the drawing, to form one unit.

Due to the fact that the linear-motion drives are accommodated in the side bars 42 and 44, they are nearly completely covered and no longer visible, to any extent worth noting. In this way the lath grid 2 according to the invention is fashioned visually advantageously.

The adjustment of the upper body-supporting part 6 and the leg-supporting part 8 relative to the central supporting part 4 is explained in the following with reference to FIG. 2.

Figure 2:
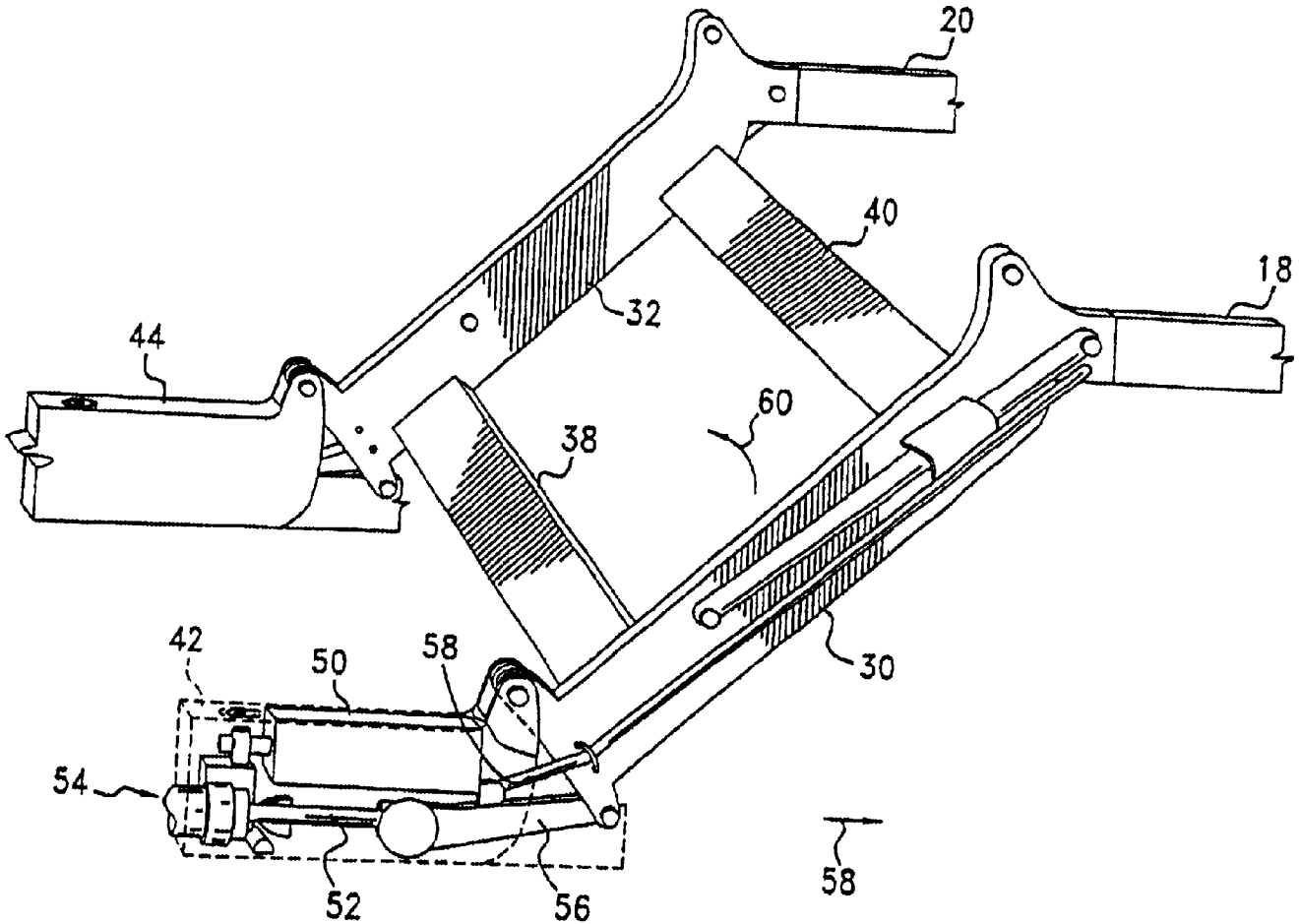
FIG. 2 illustrates the mode of action of the linear-motion drive in enlarged, schematic perspective representation, partially in phantom representation, a detail in the area of the connection of a central support part to a leg-supporting part in the embodiment according to FIG. 1.

A linear-motion drive 48 disposed in the side bar 42 has an electric motor 50 which drives a rotatably drivable threaded spindle 52 on which, as output element, a spindle nut not visible in FIG. 2, is held secure against rotation and movable in the screw direction, where the threaded spindle extends essentially parallel to the drive shaft of the electric motor 50 and stands in driving connection to it via gearing 54.

The spindle nut stands in functional connection to a pivoting mechanism for pivoting the leg-supporting part 8 relative to the central supporting part 4. The pivoting mechanism has an actuating element 56 whose end removed from the pivot axis of the leg-supporting part 8 is jointedly connected to it and whose other end is jointedly connected to the spindle nut.

From FIG. 2 it can be seen that on moving the spindle nut on the spindle 52 in the direction of an arrow 58 the leg-supporting part 8 is pivoted in the direction of an arrow 60.

In a corresponding manner an additional linear-motion drive is accommodated in the side bar 44, said linear-motion drive be driven synchronously to the linear-motion drive 48.

For pivoting the calf-supporting part 12 relative to the leg-supporting part 8 a band or belt 58 is provided whose one end is fastened to the central supporting part 4 and whose other end is fastened to the calf-supporting part 12. On pivoting of the leg-supporting part 8 relative to the central supporting part 4 the belt 58 exerts a tractive force on the calf-supporting part 12 so that it pivots relative to the leg-supporting part 8. As a function of the length of the belt 58 the pivoting of the calf-supporting part 12 relative to the leg-supporting part 8 can start at the beginning of the pivoting of the leg-supporting part 8 relative to the central supporting part 4 or on reaching a predefined adjusted position of the leg-supporting part 8 relative to the central supporting part 4. In this way the adjustment of the calf-supporting part 12 relative to the leg-supporting part 8 is coupled to the adjustment of leg-supporting part relative to the central supporting part 4 and an automatic movement of the calf-supporting part relative to the leg-supporting part 8 is achieved.

Figure 3:
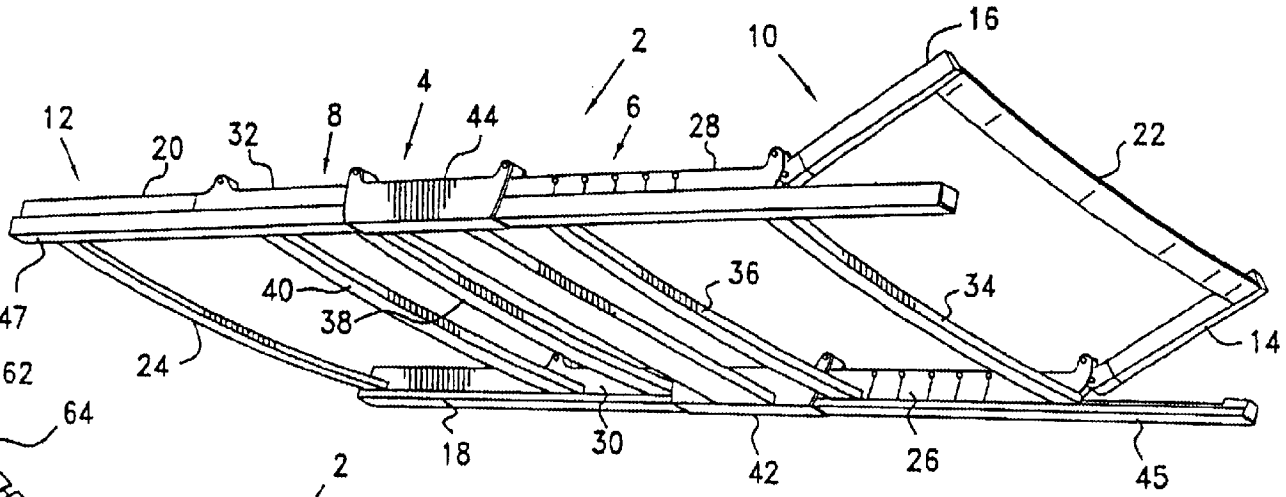
FIG. 3 shows the embodiment according to FIG. 1 in schematic perspective representation viewed from below.

From the drawings it cannot be seen and thus is explained here that, between the leg-supporting part 8 and the calf-supporting part 12, a spring or spring means in the form of gas-pressure springs are provided which seek to move the calf-supporting part 12 relative to the leg-supporting part 8 into a position in which the calf-supporting part 12 is not adjusted relative to the leg-supporting part 8; that is, into a position in which the calf-supporting part 12 and the leg-supporting part 8 together form an essentially planar supporting surface, as is represented in FIG. 3. The belt 58 thus adjusts the calf-supporting part 12 against the initial load of the gas-pressure springs.

The pivoting of the upper body-supporting part 6 can be accomplished in a corresponding manner. For this, additional linear-motion drives are disposed in the side bars 42 and 44.

FIG. 3 shows the lath grid according to FIG. 2 where the calf-supporting part 12, the leg-supporting part 8, and the upper body-supporting part 6 are not pivoted relative to the central supporting part 4 and merely the head-supporting part 10 is pivoted relative to the upper body-supporting part 6.

Figure 4:
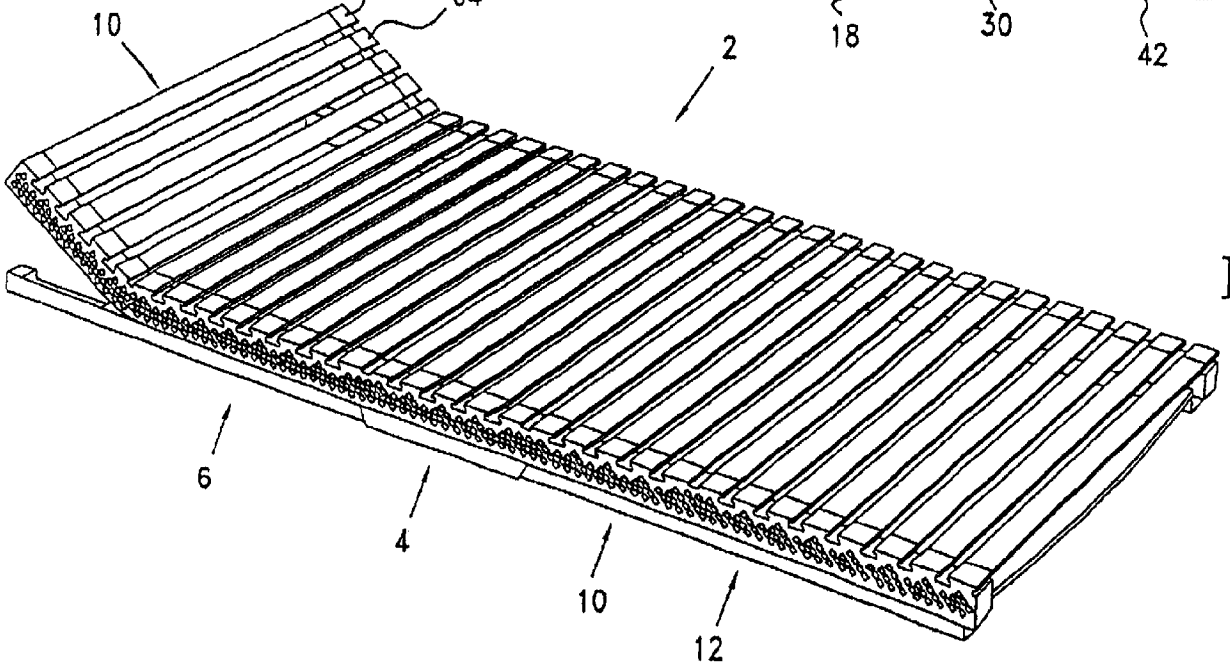
FIG. 4 shows the embodiment according to FIG. 1 wherein the head-supporting part is pivoted with respect to the rest of the supporting parts.

From FIG. 4 it can be seen that the lath grid has a plurality of laths parallel and spaced relative to one another, only two laths of which are designated with reference numbers 62 and 64. The laths 62 and 64 are held on the supporting parts 4, 6, 8, 10, and 12 by holding elements or means.

Figure 5:
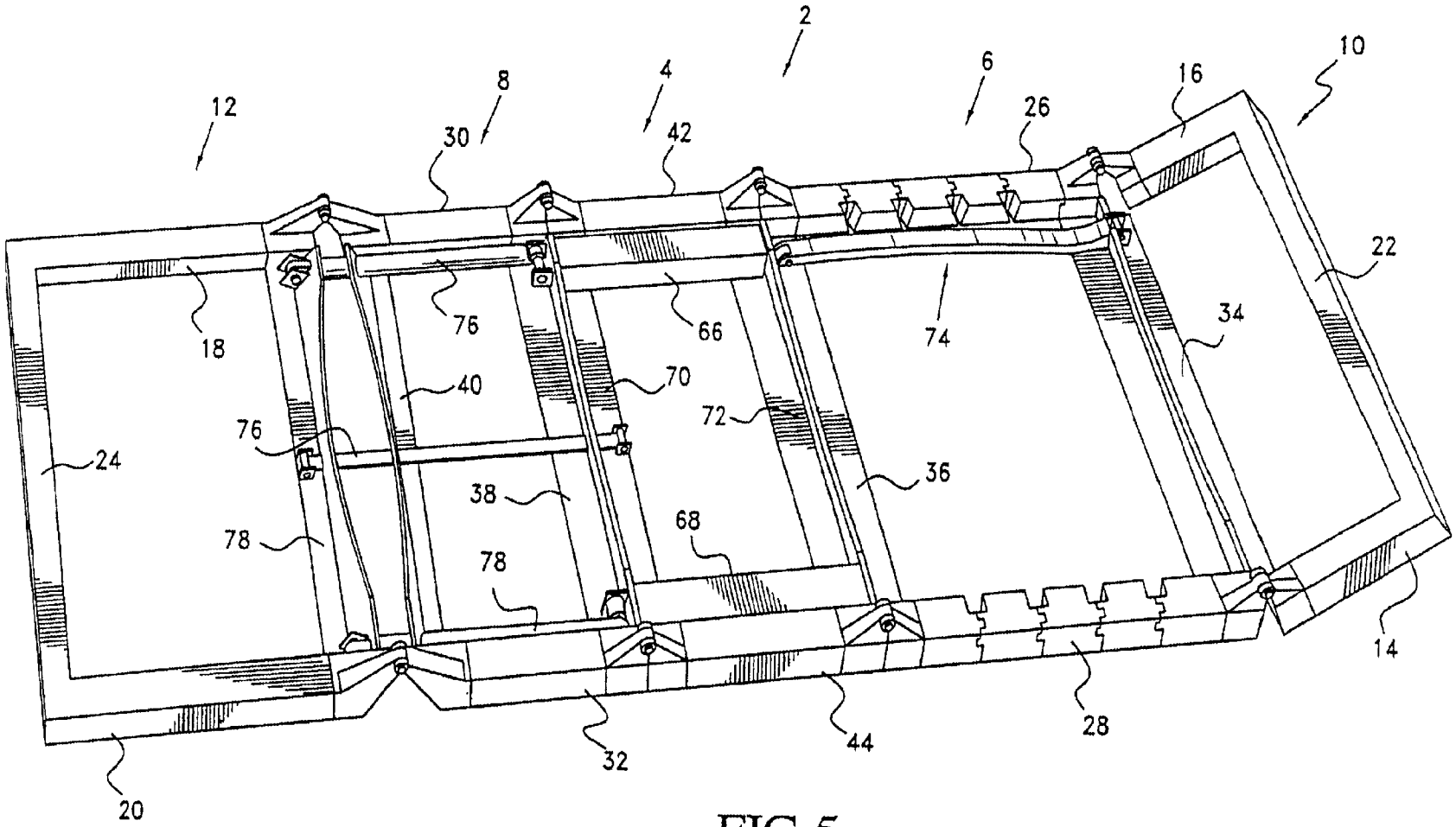
FIG. 5 illustrates in similar representation as FIG. 1 a second embodiment of the supporting device according to the invention in the form of a lath grid.

FIG. 5 shows a second embodiment of a lath grid 2 according to the invention, said lath grid being distinguished from the embodiment according to FIGS. 1 to 4 by the fact that the linear-motion drives are accommodated not in the side bars 42 and 44 but rather in the housings 66 and 68 which are connected to the side bars 42 and 44 and to the cross bar 46 of the central supporting piece 4 and are disposed on faces of the side bars 42 and 44 facing one another. In the case of this embodiment the housings 66 and 68 of the linear-motion drives are supported on cross bars 70 and 72 of the central supporting part 4 and are laid on it and thus removably connected to the central supporting part 4. If necessary, checking means for checking the housings 66 and 68 can be provided on the central supporting part 4.

Through the removable connection of the housings 66 and 68 to the central supporting part 4, the linear-motion drives can be replaced in a quick and simple manner. This increases the maintenance and ease of repair of the supporting device according to the invention.

For adjusting the upper body-supporting part 6 relative to the central supporting part 4 and the head-supporting part 10 relative to the upper body-supporting part 6, a lever mechanism 74 is provided in the case of this embodiment, said lever mechanism being in functional connection with, and linearly movable on a threaded spindle, a spindle nut of the linear-motion drive disposed in the housing 66. On movement of the spindle nut in the direction of the upper body-supporting part 8 the lever mechanism 74 exerts, in a first movement phase, a pressing force on the head-supporting part 10 so that it pivots relative to the upper body-supporting part 6. The lever mechanism 74 is formed in such a way that, in this first movement phase, the upper body-supporting part 6 is still not pivoted relative to the central supporting part 4.

In a second movement phase following the first movement phase, the lever mechanism 74 exerts a pressing force on the upper body-supporting part 6 so that it pivots relative to the central supporting part 4. In this way the pivoting movement of the head-supporting part 10 is coupled to the pivoting movement of the upper body-supporting part 6 in such a way that first the head-supporting part 10, and, following that, the upper body-supporting part 6, pivots.

In the embodiment according to FIG. 5 a spring or spring means in the form of gas-pressure springs 76 and 78 are disposed between the leg-supporting part 8 and the calf-supporting part 12, said gas-pressure springs seek to move the calf-supporting part 12 relative to the leg-supporting part 8 into the position represented in FIG. 5 in which the calf-supporting part 12 and the leg-supporting part 8 form an essentially plane supporting surface.

To adjust the leg-supporting part 8 relative to the central supporting part 4 an actuating element not represented in FIG. 5 is provided whose one end is jointedly connected to, linearly movable on threaded spindle, a spindle nut of the linear-motion drives disposed in the housing 68 and whose other end removed from the pivot axis of the leg-supporting part 8 is jointedly connected to it. On movement of the spindle nut of the linear-motion drives in the direction of the leg-supporting part 8 the actuating element exerts a pressing force on the leg-supporting part so that it pivots about its pivot axis relative to the central supporting part 4.

To adjust the calf-supporting part 12 relative to the leg-supporting part 8 a belt 76 is provided whose one end is fastened to the cross bar 70 of the central supporting part 4 and whose other end is fastened to a cross bar 78 of the calf-supporting part 12. On pivoting of the leg-supporting part 8 relative to the central supporting part 4 the belt 74 exerts a tractive force on the calf-supporting part 12 so that it pivots relative to the leg-supporting part 8 about its pivot axis. As a function of the length of the belt, the pivoting movement of the calf-supporting part 12 relative to the leg-supporting part 8 can set in at the beginning of the pivoting of the leg-supporting part 8 relative to the central supporting part 4 or later. In the case of the embodiment of FIG. 5 the belt has a fixed length. It is, however, also possible to provide a longitudinally adjustable belt so that as a function of the length of the belt currently set the pivoting movement of the calf-supporting part 12 relative to the leg-supporting part 8 occurs at an earlier or later point in time during the pivoting movement of the leg-supporting part 8 relative to the central supporting part 4. Through the belt 74 the adjustment movement of the calf-supporting part 12 relative to the leg-supporting part 8 is coupled to the adjusting movement of the leg-supporting part 8 relative to the central supporting part 4.

Figure 6:
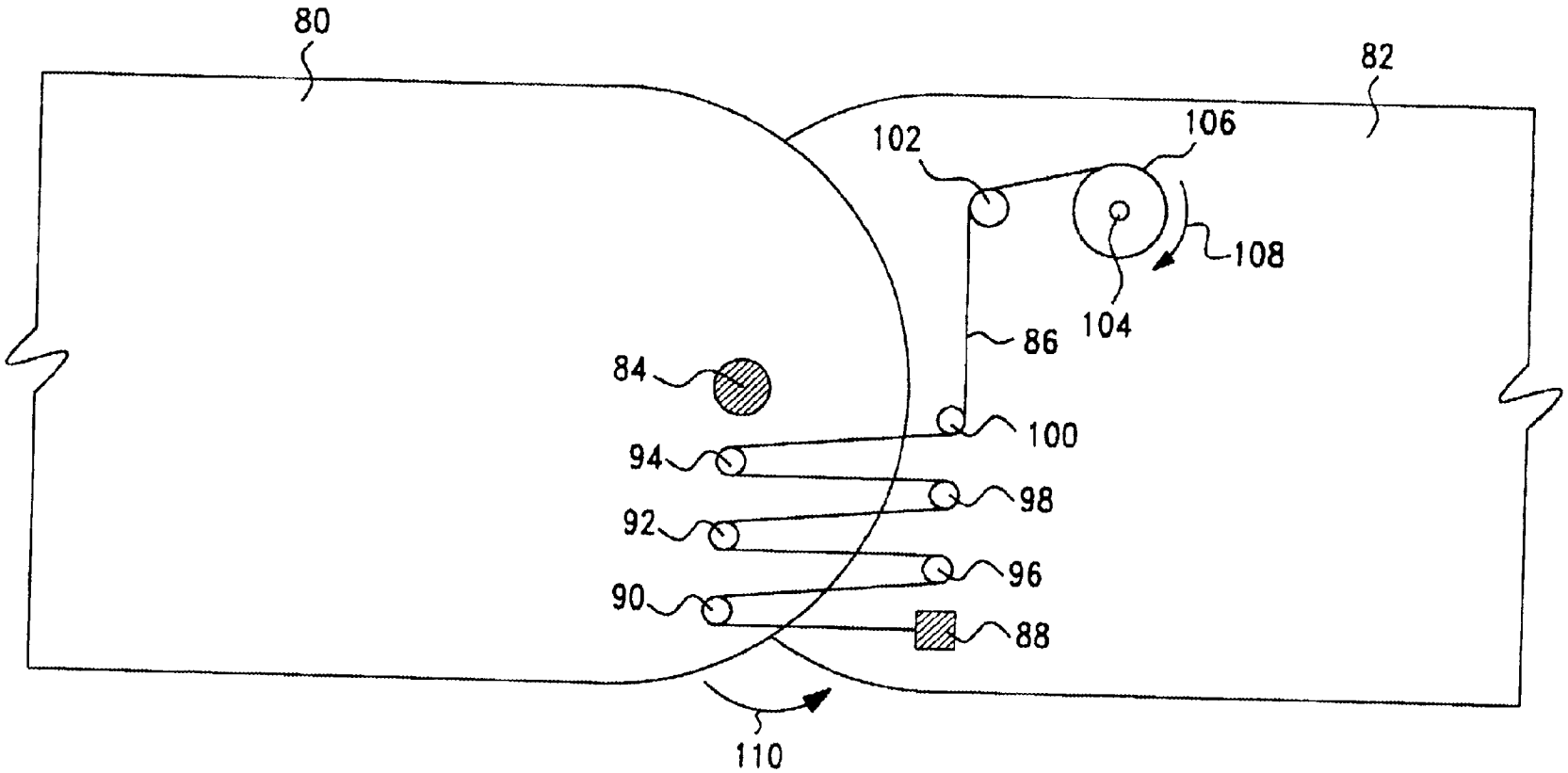
FIG. 6 shows in highly schematic representation a detail of an adjustment drive working according to the block-and-tackle principle.

FIG. 6 shows in highly schematic representation an additional embodiment of an adjustment drive for the adjustment of a supporting part 80 represented only schematically in FIG. 6 relative to a supporting part 82 also represented only schematically. The supporting parts 80 and 82 are connected to one another pivotably about a pivot axis 84, where to pivot the supporting part 80 relative to the supporting part 82 an adjustment drive is provided which has a band or belt 86. The belt 86, whose one end is fastened to a fastening point 88 on the supporting part 82, is guided in the manner of a block and tackle over rollers 90, 92, and 94 disposed on the supporting part 80 and situated rotatably on it and over rollers 96, 98, and 100 disposed on the supporting part 82 and situated rotatably on it. The end of the belt opposite the fastening point 88 is connected via a deflection roller 102 to a winding drum situated rotatably about a rotary axis 104 and rotatably drivable by means of a rotary drive not represented. On rotating of the winding drum 106 in the direction of an arrow 108 the winding drum 106 winds the belt up which is shortened thereby and the supporting part 80 pivots relative to the supporting part 82 in the direction of the arrow 110. This makes possible in a particularly simple manner pivoting of the supporting part 80 relative to the supporting part 82. Due to the fact that the belt 86 is guided in the manner of a block and tackle about the rollers 90, 92, 94, 96, 98, and 100, only small forces are required for winding up of the belt 86. The rotary drive of the winding drum 106 can thus be formed by a correspondingly small motor. The elements of the adjustment drive represented in FIG. 6 can, by way of example, be accommodated in the supporting parts 80 and 82 by their shafts being formed as hollow profiles. The adjustment drive then does not appear visually.

The adjustment drive represented in FIG. 6 is not only usable for the adjustment of supporting parts of a supporting device of a piece of furniture but rather wherever a pivoting movement between two parts relative to one another is required.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention or limits of the claims appended hereto.

What is claimed is:

1. An adjustable supporting device for upholstery of one of seating and reclining furniture, comprising:

a) a first supporting part, said first supporting part being configured for supporting the upholstery, and said first supporting part defining an upper limiting plane and a lower limiting plane;

b) a second supporting part disposed adjacent the first supporting part, the second supporting part being configured for supporting the upholstery;

c) the first supporting part and the second supporting part being jointedly connected to one another and pivotable relative to one another;

d) an electromotive drive disposed on the first supporting part;

e) the first supporting part including a substantially hollow profile, and the electromotive drive being substantially accommodated within the hollow profile;

f) the electromotive drive including an output element operatively associated with the first and second supporting parts for pivoting the first and second supporting parts relative to each other; and g) the electromotive drive being disposed between the upper limiting plane and the lower limiting plane of the first supporting part.

2. Supporting device according to claim 1, wherein:

a) the drive is disposed essentially completely between the upper limiting plane and the lower limiting plane of the first supporting part.

3. Supporting device according to claim 1, wherein:

a) the first supporting part includes at least one side bar formed as the substantially hollow profile.

4. Supporting device according to claim 3, wherein:

a) the drive is removably connected to one of the at least one side bar.

5. Supporting device according to claim 1, wherein:

a) the drive is disposed between lateral limiting planes of the first supporting part.

6. Supporting device according to claim 4, wherein:

a) the drive is accommodated in a housing.

7. Supporting device according to claim 6, wherein:

a) the housing is connected to one of the at least one side bar and a cross bar of the first supporting part.

8. Supporting device according to claim 6, wherein:

a) the drive includes two drives disposed in the housing in such a way that a double drive is formed.

9. Supporting device according to claim 3, wherein:

a) the at least one side bar of the first supporting part includes two side bars spaced relative to one another in a transverse direction relative to the first supporting part, and each of the at least one side bar is assigned to a housing in which at least one linear-motion drive is accommodated.

10. Supporting device according to claim 1, wherein:

a) the drive includes a linear motion drive; and b) the output element of the drive is movable substantially in a longitudinal direction of the first supporting part.

11. Supporting device according to claim 1, wherein:

a) the drive includes a linear-motion drive.

12. Supporting device according to claim 11, wherein:

a) the output element of the linear-motion drive includes a spindle nut which is held, secure against rotation and movable in a screw direction, on a threaded spindle rotatably drivable by the drive, and the spindle nut is in functional connection with a lever mechanism for pivoting the second supporting part relative to the first supporting part.

13. Supporting device according to claim 12, wherein:

a) the threaded spindle is disposed essentially parallel to a drive shaft of the linear-motion drive and is in functional connection with the linear-motion drive via gearing.

14. Supporting device according to claim 1, wherein:

a) the first supporting part is formed by a central supporting part and the second supporting part is formed by an upper body-supporting part, and a leg-supporting part is provided which is connected, jointedly and pivotably about a pivot axis essentially parallel to a pivot axis of the upper body-supporting part, to the central supporting part on a side opposite the upper body-supporting part.

15. Supporting device according to claim 14, wherein:

a) a head-supporting part is provided which is connected, jointedly and pivotably, about a pivot axis essentially parallel to a pivot axis of the upper body-supporting part, to the upper body-supporting part on a side opposite the central supporting part.

16. Supporting device according to claim 14, wherein:

a) a calf-supporting part is provided which is connected, jointedly and pivotably, about a pivot axis essentially parallel to the pivot axis between the central supporting part and the leg-supporting part, to the leg-supporting part on a side opposite the central supporting part.

17. Supporting device according to claim 1, wherein:

a) one of the first and second supporting parts includes a lath grid.

18. Supporting device according to claim 1, wherein:

a) the reclining furniture includes a mattress.

19. Supporting device according to claim 1, wherein:

a) the reclining furniture includes a bed.

20. Supporting device according to claim 3, wherein:

a) the reclining furniture includes a bed.

21. Supporting device according to claim 1, wherein:

a) the electromotive drive includes an electric motor.

22. Supporting device according to claim 1, wherein:

a) the electromotive drive is completely accommodated within the hollow profile.

23. An adjustable supporting device for upholstery of one of seating and reclining furniture, comprising:

a) a first supporting part, the first supporting part being configured for supporting the upholstery, and the first supporting part defining an upper limiting plane and a lower limiting plane;

b) a second supporting part provided adjacent the first supporting part, the second supporting part being configured for supporting the upholstery;

c) the first supporting part and the second supporting part being pivotably connected to one another and pivotable relative to one another;

d) an electromotive drive provided on the first supporting part;

e) the first supporting part including a substantially hollow profile, and the electromotive drive being at least substantially accommodated within the hollow profile;

f) the electromotive drive being operatively associated with the first and second supporting parts for pivoting the first and second supporting parts relative to each other; and g) the electromotive drive being disposed substantially between the upper limiting plane and the lower limiting plane of the first supporting part.

24. Supporting device according to claim 23, wherein:

a) the first supporting part includes at least one side bar, and the at least one side bar defines the substantially hollow profile.

* * * * *